United States Patent [19]

Waddell et al.

[11] Patent Number: 4,629,178

[45] Date of Patent: Dec. 16, 1986

[54] DOCUMENT CONVEYOR SYSTEM

[75] Inventors: George M. Waddell, Carluke, Scotland; Dennis Hall, Carshalton, United Kingdom

[73] Assignee: Burroughs Corporation, Detroit, Mich.

[21] Appl. No.: 594,039

[22] Filed: Mar. 27, 1984

[30] Foreign Application Priority Data

Nov. 15, 1983 [GB] United Kingdom ..... 8330447

[51] Int. Cl.[4] ..... B65H 9/16

[52] U.S. Cl. ..... 271/251; 38/48; 198/644; 226/196; 271/272; 271/275

[58] Field of Search ..... 271/251, 264, 272, 273, 271/274, 314, 275; 198/836, 644, 624; 226/187, 188, 196, 186; 38/44, 52, 48

[56] References Cited

U.S. PATENT DOCUMENTS

| | | | |
|---|---|---|---|
| 3,856,132 | 12/1974 | Sakurai et al. | 271/275 |
| 4,045,018 | 8/1977 | Michelson | 271/251 |
| 4,288,934 | 9/1981 | Gasser | 38/44 |

*Primary Examiner*—Joseph J. Rolla
*Assistant Examiner*—John A. Carroll
*Attorney, Agent, or Firm*—Mark T. Starr; Kevin R. Peterson

[57] ABSTRACT

A transport mechanism is disclosed for transporting a document around a track in a groove. A boundary wall in the form of a continuous wall or an array of guide cylinders is provided on the outside of a corner around which the track passes. A breaking cylinder which is rotated with the same surface velocity as the document constricts the document against the boundary and opens out any longitudinal folds therein to reduce the mechanical strength which they cause in the document. A drive mechanism then flattens the document against the boundary and renders the document flexible for the continuation of its transportation around the curved track. Dog-ears on the leading edge of a document are conditioned to prevent their causing impediment to further document transportation either by being folded back against the document or by being folded back into the plane of the document.

44 Claims, 8 Drawing Figures

DOCUMENT CONVEYOR SYSTEM

BACKGROUND TO THE INVENTION

1. Field of the Invention

The present invention relates to a document conveyor for the transportation of a document around a corner. It further relates to such a transport mechanism for use in banking equipment for the transportation of checks and other documents which may have been subjected to crumpling and folding before being presented to the banking equipment. It yet further relates to an apparatus capable of dealing with dog-ears on documents to render a dog-eared document capable of transportation in conventional tracks.

2. The Prior Art

It is well-known in banking to employ check encoding machines for the automatic handling of checks and related documents. A check encoding machine is fed with a stack of checks, and the individual checks are transported throughout the machine for data to be read therefrom and to be stacked in an appropriate output pile. In order to minimize the size of such machines, it is necessary to deviate from the otherwise ideal construction of a single straight track, and to use a track including one or more curves. The checks or related documents are subjected to mechanical abuse by the public before receipt thereof by the banking system. The checks can be folded. Folds in a document impart mechanical strength to the document which it would otherwise not possess. There is, therefore, a problem in handling folded documents, particularly those having a fold or folds lying in the direction of transportation. Firstly the document, being folded, presents a larger effective cross-sectional area than would otherwise be expected and runs the risk of jamming against the sides of narrow openings which would otherwise accept the document. The fold or folds in the document impart longitudinal strength to the document which resists its forceable entry into an opening. When the limit of the mechanical strength of the folded document is overcome, the document can give way and collapse causing a jam in the document transport mechanism.

The transportation of a folded document can be achieved around corners of very large radius where the frictional opposing force of the folded document against the boundaries of the corner in opposition to the document's movement is insufficient either to stop the document or to cause its collapse. It is inefficient to build document processing equipment where documents are moved around large radii corners by virtue of the additional dimensions required of the equipment to accommodate the corners of large radii. It is therefore desirable to provide a document conveyor capable of moving documents, folded in a direction lying in the direction of transportation, around a corner of small radius.

A dog-ear is hereinbefore and hereinafter defined as a portion of the leading edge of a document folded out of the plane of the document.

Mishandling of checks and banking documents often means that a document becomes dog-eared, that is to say, that a corner of the document becomes folded out of the plane of the document. The dog-ear adds to the width of the document, and is able to prevent the ingress of the document into document-handling tracks. It is therefore desirable to provide an apparatus capable of rendering a dog-eared document suitable for transportation along a document track.

SUMMARY OF THE INVENTION

The present invention resides in a document conveyor for transporting a document around a corner.

The document conveyor includes a curved track for guiding an edge of a document in a curved path around the corner. A driver is provided for urging the document along the curved path.

A curved boundary, adjacent to the rack on the outside of the corner, supports the document transversely to the surface of the document and to the path. A breaking cylinder is disposed in a spaced relationship to the boundary across the entrance to the conveyor.

The breaking cylinder and the boundary are cooperable, upon a document entering the conveyor and passing therebetween, to open a fold or folds in the document lying in the direction of the path, to thereby reduce the mechanical strength imparted to the document transverse to the surface of the document by the fold or folds in the direction of the path.

Thereafter, the driver is operable to urge the document against the curved boundary and thereby flatten the document against the curved boundary in order to make the document flexible for the completion of its transportation around the corner.

BRIEF DESCRIPTION OF THE PREFERRED EMBODIMENT

In a first preferred embodiment there is provided a curved track, wherein a groove accepts the lower edge of a document. A curved boundary is provided adjacent to the track. In the first preferred embodiment, the curved boundary is a wall. The wall supports the document against tilting out of the track as the document goes around the curve. The wall preferably forms one side of the groove and extends throughout the height of the document. A breaking cylinder is provided at the entrance to the document conveyor on the side of the track opposite the wall spaced away from the wall. A document enters the conveyor by passing between the breaking cylinder and the wall. The breaking cylinder cooperates with the wall to open out any longitudinal folds in the document as it enters the conveyor.

The document is urged into the conveyor and around the curve by a driver. The driver preferably consists in a driven friction wheel pressing against an idler pinch wheel. The document is preferably gripped near its edge adjacent to the groove between the friction wheel and the idler wheel to be urged around the track.

The driver urges the document, whose folds have been opened out, around the track and against the wall. The document is flattened against the wall and thereby rendered flexible for continued transportation around the corner.

The breaking cylinder is rotated in such a manner as to urge the document around the track and, in the event of a fold striking the breaking cylinder, the rotation of the breaking cylinder urges the corner of the fold towards the wall, thereby preventing jamming of the document. It is preferred that the breaking cylinder rotates with a surface velocity equal to the transportation velocity of the document around the track. The breaking cylinder is preferably mounted to be corotational with the friction wheel, in which case, the breaking cylinder is preferably coaxially mounted atop, and co-rotational with, the friction wheel.

The breaking cylinder is tilted through a small predetermined angle in the direction of transportation of the document such that the rotation of the breaking cylinder tends to urge the document into the groove. The friction wheel and idler pinch wheel assembly is preferably angled in a similar manner also to urge the document into the groove in the track.

In a first version of the first preferred embodiment, the combination of the breaking cylinder and the driven friction wheel is preferably driven by means of a motor coupled coaxially beneath the track to the driven friction wheel. In a second version of the first preferred embodiment, the breaking cylinder assembly is preferably driven by means of a belt drive which, in turn, rotates the driven friction wheel.

The wall preferably comprises a lip adjacent to the breaking cylinder at the entrance of the conveyor for forming a reducing path between the wall and the breaking cylinder for the gradual opening of a fold or folds in the document.

In a second preferred embodiment of the invention, everything is as for the first preferred embodiment save that the curved boundary, previously a wall, is replaced by a plurality of guide cylinders arranged on the far side of the groove on the outside of the curve around the curved track. In a first version of the second preferred embodiment, the guide cylinders are idler cylinders rotatable by virtue of the passing document engaging therewith. In a second version of the second preferred embodiment, the guide cylinders are actively rotated to assist the document around the track. Where the breaking cylinder is rotated via a belt drive mechanism, the belt drive mechanism is preferably adapted to drive the guide cylinders. In a preferred variation upon the second version of the second preferred embodiment, the guide cylinders are angled in the same manner as for the breaking cylinder to urge the document into the groove in the track.

Both the first and second preferred embodiments are operable to deal with dog-ears on the leading edge of a document. The dog-ear is presented between the breaking cylinder and the boundary at the entrance to the conveyor. If the tip of the dog-ear lies at less than a predetermined distance from the plane of the document, the dog-ear is entrained between the breaking cylinder and the boundary, and thus straightened out to lie once more in the plane of the document. If the tip of the dog-ear is at more than a predetermined distance from the plane of the document, the boundary from the breaking cylinder folds the dog-ear right back against the surface of the document. In either case, the progress-impeding additional width imparted to the document by the dog-ear is removed.

BRIEF DESCRIPTION OF THE DRAWINGS

The invention is further described, by way of example, by the following description in conjunction with the appended drawings, in which.

DETAILED DESCRIPTION OF THE PREFERRED EMBODIMENT

Figure 1:
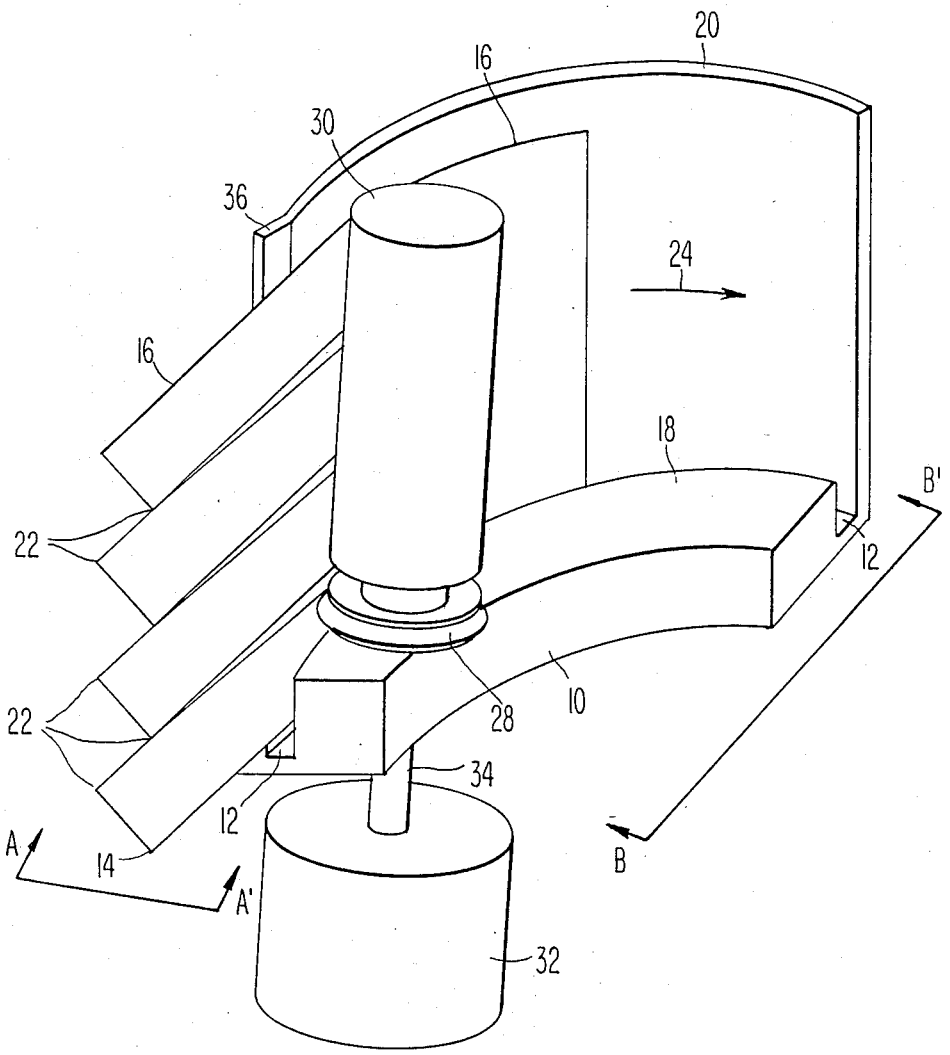
FIG. 1 shows a projected view of a first version of the first preferred embodiment.

FIG. 1 shows a projected view of the first preferred embodiment of the invention.

A curved track 10 comprises a groove 12 wherein the lower edge 14 of a document 16 is accepted. The groove 12 acts to guide the document 16 around the corner defined by the curved track 10. A platform 18 defines the limit of the groove 12 on the inside of the corner, and a curved boundary in the form of a boundary wall 20 defines the side of the groove 12 on the outside of the corner. It is preferred that the boundary wall 20 itself defines the outside limit of the groove 12. It is, however, acceptable that the boundary wall 20 be separate from the groove 12 and merely placed adjacent thereto. A degree of radial separation between the outer limit of the groove 12 and the boundary wall 20 is also acceptable in a manner which will become clear from the later description.

The document 16 may comprise one or more longitudinal folds 22. The longitudinal folds 22 need not lie exactly in the direction of transport of the document 16 as indicated by a first arrow 24 for the folds 22 to impart strength to the document 16. It is merely necessary that the folds 22 have a directional component lying in the direction of transportation. The longitudinal folds 22 are undesirable and impart a mechanical strength to the document 16 which resists bending of the document 16 in a direction transverse both to its direction of transportation and to its surface.

A driven friction wheel 28 engages the document 16 near to its lower edge 14. The driven friction wheel is rotationally mounted upon the platform 18. A breaking cylinder 30 is coaxially mounted upon the driven friction wheel 28. The breaking cylinder 30 rotates with the friction wheel 28 and is affixed thereto. Both are driven by a coaxial direct drive motor 32 mounted beneath the platform 18 and imparting rotational drive to the combination of the breaking cylinder 30 and the driven friction wheel 28 by means of a direct drive shaft 34 through penetrative of the platform 18.

The breaking cylinder 30 is spaced away from the boundary wall 20 by a distance sufficient to allow the passage of a folded document 16 therebetween. The boundary wall 20 comprises an entrance lip 36 adjacent to the breaking cylinder 30.

As the folded document 16 is engaged by the friction wheel 28, it is drawn into the space between the breaking cylinder 30 and the boundary wall 20 with its entrance lip 36. The folds can be a little wider than the clearance between the breaking cylinder and the entrance lip 36 since any sharp corners of a fold can slide against the curved surface of the breaking cylinder 30 and the angled surface of the entrance lip 36. Further, the rotation of the breaking cylinder 30 is operative to cause the breaking cylinder 30 to deflect any sharp folded edges and to draw the folded document 16 towards the space between the breaking cylinder 30 and the boundary wall 20,36.

The combination of the entrance lip 36 and the breaking cylinder 30 form a reducing path for the document 16 as it proceeds into the track 10. The curve of the cylindrical surface of the breaking cylinder 30 and the entrance lip and the wall 20 cooperate to steadily reduce the amount of width available to the document 16 and thereby to open out the folds 22 in the document 16. By opening out the folds 22, the mechanical strength imparted to the document 16 which would otherwise resist bending of the document in a direction both transverse to its path and to its surface is reduced. The residual small angle allowed to remain at the apex of each fold 22 is no longer sufficient for the document 16 to resist flexing by jamming against the boundary wall 20. The friction between the document 16 and the boundary wall 20 is such that the document 16 slides thereagainst despite any residual fold, and the document 16 is thereby flattened against the boundary wall 20 to become totally flexible for continued transportation around the groove 12.

The force for flattening the document 16 against the boundary wall 20 is imparted via the friction wheel 28 and, in part, via the breaking cylinder 30 from the direct drive motor 32. The direct drive motor 32 can be a speed controlled brushed or brushless commutator motor, or can equally be a stepping motor. The direct drive may be imparted via a gear box.

Figure 2:
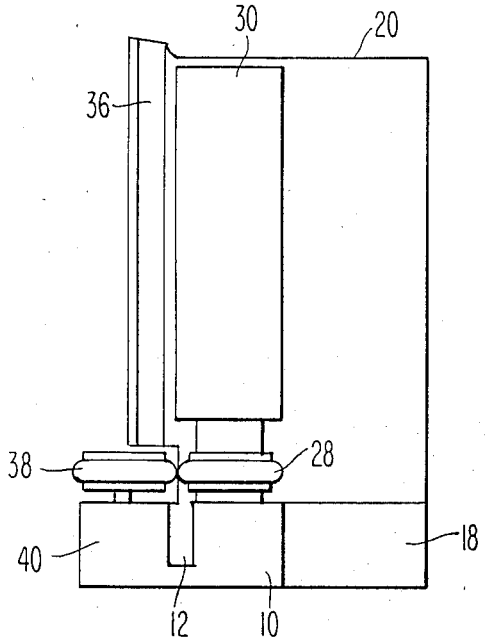
FIG. 2 shows the apparatus of FIG. 1 viewed along the line A—A′ in the direction of the arrows.

FIG. 2 shows a view of the conveyor apparatus of FIG. 1 viewed along the line A—A′ in the direction of the arrows. The direct drive motor 32 is omitted for simplicity.

The friction wheel 28 rotates in engagement with an idler pinch wheel 38 mounted on an entrance platform 40 of the track 10 on the opposite side of the groove 12. The breaking cylinder 30 is mounted such that its axis is parallel to the plane of the boundary wall 20 adjacent to the entrance lip 36, and parallel to the surface of a document 16 as it enters the transport mechanism. It is not necessary that the axis of the breaking cylinder 30 to be exactly parallel to the wall 20 at the entrance to the track 10,12. The breaking cylinder 30 can be angled to accommodate wider folds 22 in one portion of a document 16 than in another without departing from the operation of the invention as described. Similarly, the role of the idler pinch wheel 38 and the driven friction wheel 28 can be reversed, the idler wheel 38 being driven instead by the motor 32 and imparting rotation to the friction wheel 28 by mechanical frictional coupling both directly and, when a document 16 is present, through the document 16. In either case, the rotation of the driven friction wheel 28 imparts rotation to the breaking cylinder 30 which is coaxially attached thereto.

Figure 3:
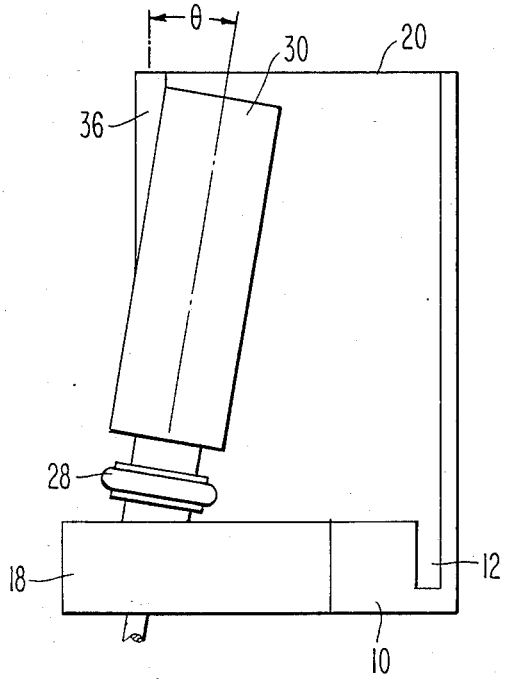
FIG. 3 shows the apparatus of FIG. 1 viewed along the line B—B′ in the direction of the arrows.

FIG. 3 shows the apparatus of FIG. 1 viewed along the line B—B′ in the direction of the arrows. Once again the direct drive motor 32 has been omitted for simplicity.

The axis 42 of the breaking cylinder 30 is tilted through an angle $\theta$ away from being at 90° to the direction of transportation of a document 16 such that the rotation of the breaking cylinder 30 urges the document 16 down into the groove 12 as it passes along the track 10. The axis of the friction wheel 28 is similarly tilted, and it too urges the document 16 into the groove 12. It is preferred that the idler wheel 38 is similarly angled, but those skilled in the art will be aware of methods whereby the idler wheel 38 may be placed in another plane.

The friction wheel 28 and the idler wheel 38 combination is employed in the preferred embodiment of the the present invention merely by way of preference. Any other method for transporting a document 16 along the track 10 in the groove 12 would be acceptable. The breaking cylinder 30 can be made independently rotatable. It is preferred that the breaking cylinder 30 rotates with a surface velocity equal to the velocity of transportation of the document 16 around the track 10. In the preferred embodiment here shown, this is achieved by arranging that the diameter of the breaking cylinder 30 be the same as the diameter of the friction wheel 28. The breaking cylinder 30 can be rotated with a surface velocity greater than the velocity of transportation of the document 16, the better to urge the document 16 into the groove 12 of the track 10. Equally the breaking cylinder 30 can be made of low-friction material for the document 16 to slide without impediment thereagainst whenever a difference between the velocity of transportation of the document 16 and the surface velocity of the breaking cylinder 30 exists.

The apparatus shown in FIGS. 1, 2 and 3 provides the transportation of a document 16 through an angle of 90°. It is to be appreciated that the document may be transported through an angle greater or less than 90°. It is further to be appreciated that additional drivers may be included around the track 10 for moving the document 16. The additional drivers can comprise extra pairs of friction drive wheels 28 and idler wheels 38 arranged to pick up the document 16 before the document 16 passes completely from another pair of friction wheels 28 and idler wheels 38 earlier in the track 10.

Figure 4:
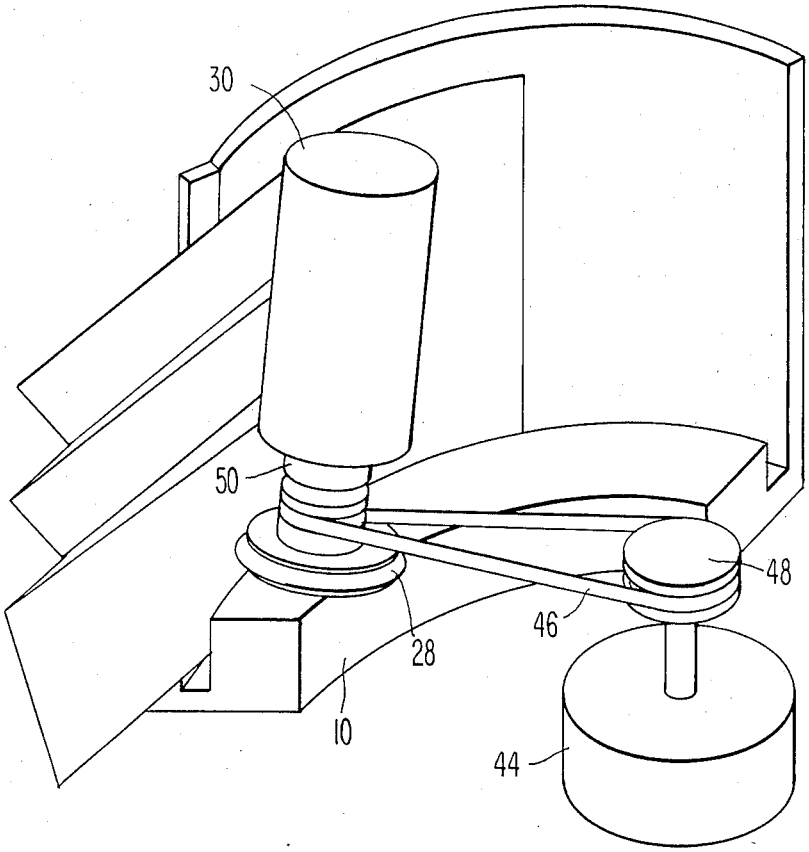
FIG. 4 shows a second version of the first preferred embodiment.

FIG. 4 shows a variation upon the preferred embodiment of FIG. 1 allowing the transport mechanism to be mounted entirely upon a flat surface with no element thereof penetrating below the level of the track 10. Instead of the direct drive motor 32, a belt drive motor 44 is provided for driving the combination of the breaking cylinder 30 and the friction wheel 28 by means of a belt 46 passing around a pulley 48 on the belt drive motor 44, and around a waisted section 50 between the breaking cylinder 30 and the friction wheel 28. The belt drive motor 44 can be mounted substantially in the plane of the track 10 and projection of the document conveyor beneath the plane of the track 10 is therefore unnecessary. The waisted section 50, although shown in FIG. 4 for the sake of clarity as being fairly large, should in fact, encompass as little as possible of the length of the breaking cylinder 30 so that the breaking cylinder 30 is able to engage the maximum number of folds 22 across the width of a document 16 to open the folds 22. As an alternative construction, the waisted section 50 can be made as a simple slot in the surface of the breaking cylinder 30.

Figure 5:
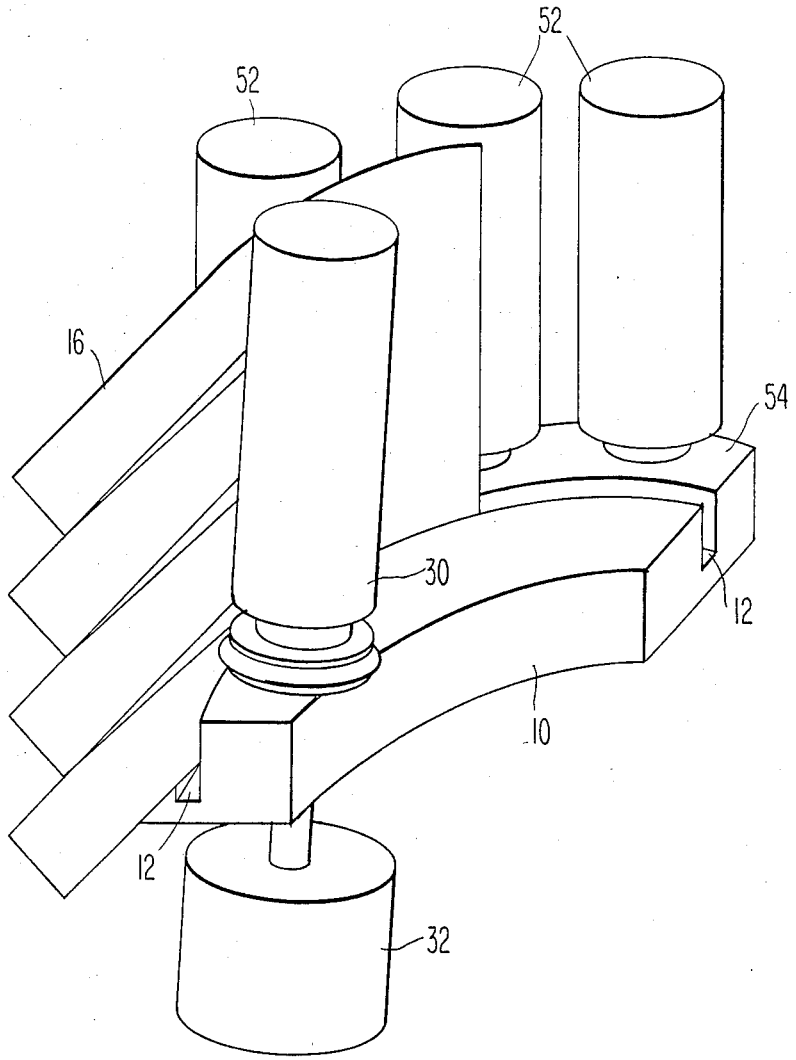
FIG. 5 shows a projected view of the second preferred embodiment.

FIG. 5 shows a second preferred embodiment of the invention. Everything is as shown in FIG. 1, save that the wall 20 has been replaced by a plural array of guide cylinders 52 arranged on the track 10 on the outside of the curve on a shoulder 54 of the track 10. The guide cylinders 52 define a path for the document 16 identical to that otherwise defined by the wall 20. The first guide cylinder 52 in the track 10, by virtue of its curved surface, effectively performs the same operation as is performed by the wall 20 and the entrance lip 36 shown in FIG. 1. Whilst the guide cylinders are here shown as being of the same diameter as the breaking cylinder 30, it is to be appreciated that the guide cylinders 52 can have a different diameter from that of the breaking cylinder 30. Further, the guide cylinders 52 need not have the same diameter as one another.

In a first version of the second preferred embodiment, the guide cylinders 52 are idler cylinders. The guide cylinders 52 are mounted to rotate about their axes in the shoulder 54 of the track 10. When the document 16 impinges upon the guide cylinders 52, the guide cylinders 52 rotate by virtue of the friction of the document 16 and impart a frictional obstruction to the passage of the document 16 which is less than that which would be imparted by the wall 20 of FIG. 1. The guide cylinders are mounted with their axes parallel to the surface of the document 16, and at a right angle to the path of the document 16.

In a second version of the second preferred embodiment, the guide cylinders 52 are driven. The guide cylinders 52 are driven to rotate with a surface velocity equal to the velocity of transportation of the document 16. The document 16 therefore experiences no friction against the guide cylinders 52. The guide cylinders 52 can each be rotated by an independent motor. The guide cylinders 52 may be rotated by a common motor. Similarly, both the guide cylinders 52 and the breaking cylinder 30 may be rotated by the same motor. In this second version of the second preferred embodiment, it is preferred that the guide cylinders 52 are angled to tilt in the direction of movement of the document 16 in the same manner as for the breaking cylinder 30 for urging the document 16 into the groove 12. The guide cylinders 52 can be operated in conjunction with a friction wheel 28 and pinch wheel 38 pair in the same manner as the breaking cylinder is operated.

Whilst the second preferred embodiment shown in FIG. 5 is shown used in conjunction with a direct drive motor 32, it is to be appreciated that the embodiment of FIG. 5 can equally be used with any belt drive arrangement 44, 48, 46, 50 shown in FIG. 4, and imparting the same space-saving advantage.

The angle of tilt $\theta$ of the axis of the breaking cylinder 30 is, in the preferred embodiment hereinbefore described, chosen to be in the range 5° to 10°. It is to be appreciated that the angle $\theta$ can be chosen to have a different value dependently upon the frictional properties of the document 16 with the track 12, the breaking cylinder 30, the boundary 20,52, and the combination of the friction wheel 28 and the idler wheel 38.

Figure 6A:
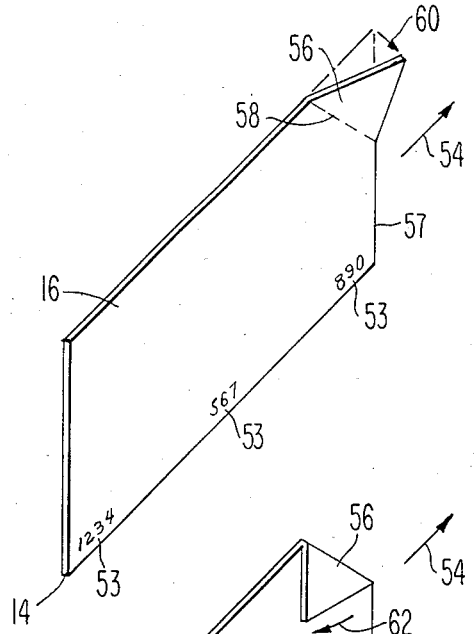
FIGS. 6A, 6B and 6C are respectively illustrative of a dog-ear on a document before presentation to the conveyor of any of the previous Figures, of a dog-ear being folded back to the document, and of a dog-ear being folded back into the plane of a document.

FIG. 6A shows a document 16 in a dog-eared condition. A row of numbers 53 to be read by the banking equipment is provided proximate to the lower edge 14 of the document 16. The document 16 is conveyed in the direction of a second arrow 54. A dog-ear 56 occurs in the leading edge 57 of the document 16 by folding along a fold line 58 out of the plane of the document 16 as indicated by a third arrow 60.

Figure 6B:
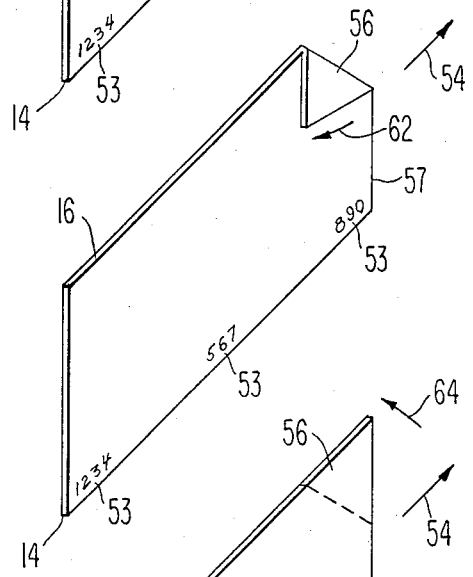

FIG. 6B shows the result of passing the document 16 through the conveyors of FIGS. 1 to 5, where the tip of the dog-ear 56 is far enough out of the plane of the document 16 for the tip to be pushed back by the breaking cylinder 30. In being pushed back, the dog-ear 56 is folded, as indicated by a fourth arrow 62, to lie flat against the plane of the document 16. Since the row of figures 53 to be read by the equipment (by means not shown) lies proximate to the bottom edge 14 of the document 16, the folding over of the dog-ear 56 as shown in FIG. 6B in no way impairs the subsequent action of the reader, renders the document 16 flexible and of substantially the same cross-sectional area as it would have been if the dog-ear 56 had not existed. The document 16 is thereby thereafter allowed access into conventional document-handling conveyors.

Figure 6C:
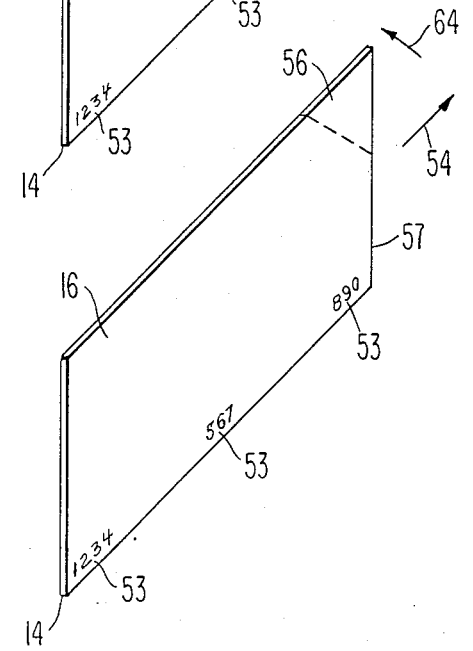

FIG. 6C shows the document 16 of FIG. 6A having passed through the conveyors of FIGS. 1 to 5, where the tip of the dog-ear 56 was sufficiently close to the plane of the document 16 to become entrained between the breaking cylinder 30 and the boundary 20,52 to be folded back into the plane of the document 16 as indicated by a fifth arrow 64. The rotation of the breaking cylinder 30 has the effect of pulling the dog-ear 56 into the plane of the document 16 by catching the dog-ear 56 by friction. In this instance, it is preferred that the breaking cylinder 30 rotates with a surface velocity in excess of the linear velocity of the document 16 in the track 10.

Whilst in FIGS. 6A and 6B it has been assumed that the dog-ear 56 lies to that side of the document 16 whereon the breaking cylinder 30 is situated, it is to be appreciated that a dog-ear 56 lying on the other side of the document 16 will be in engagement with the boundary 20, and be folded back against the document 16. If the boundary 20 consists in a series of driven guide cylinders 52 as shown in FIG. 5, the first guide cylinder 52 encountered by the document 16 can be driven with a surface velocity higher than the linear velocity of transport of the document 16 for the first-encountered guide cylinder 52 to be able to open out any dog-ear 56 whose tip is within a predetermined distance away from the plane of the document 16 back into the plane of the document 16 as shown in FIG. 6C.

Whilst the document 16 shown in FIGS. 6A, 6B and 6C have not been shown as possessing any longitudinal folds 22, it is to be appreciated that the documents 16 in FIGS. 6A, 6B and 6C can equally well include longitudinal folds 22.

The invention and its embodiments hereinbefore described have the effect of conditioning a document 16 in such a way that it can be handled by conventional prior art document-handling equipment subsequently to its passage through the conveyor systems described with respect to the present invention. The present invention may therefore be used ssimply as a document conditioning station without necessarily turning a document 16 through an angle. Thus, the track 10 need only be curved through a small angle sufficient to break the longitudinal folds 22 as a document 16 is driven by the driver 38,28 against the boundary 20,52. Similarly, the function of the breaking cylinder 30 and the boundary 20,52 being cooperative to reduce and eliminate the impediment to document progress caused by a dog-ear 56 can be separately employed at the beginning of, and throughout, document-handling equipment for the removal of dog-ears 56 and for the reconditioning of dog-ears 56 which may re-establish themselves during the transportation of a document 16.

What I claim is:

1. A document conveyor for the transportation of a document around a corner, said conveyor comprising:

a curved track for guiding an edge of a document in a curved path around said corner;

a driver for urging a document along said path;

a curved boundary adjacent to said track on the outside of said corner for supporting a document transversely to the surface of the document and to said path; and a breaking cylinder, disposed in a spaced relationship to said boundary across the entrance to said conveyor, where said breaking cylinder and said boundary are co-operable, upon a document entering said conveyor by passage therebetween, to open a fold or folds in the document lying in the direction of said path for the reduction of the mechanical strength imparted to the document transverse to the surface of the document by the fold or folds in the direction of said path, and where, thereafter, said driver is operable to urge the document against said curved boundary for the document to be flattened against said curved boundary to be rendered flexible for the completion of said transportation around said corner.

2. A document conveyor according to claim 1, wherein said breaking cylinder and said boundary are co-operable to engage a dog-ear on a document therebetween to turn the dog-ear into the plane of the document by the folding of the dog-ear back into the plane of the document if the tip of the dog-ear is initially at less than a predetermined distance from the plane of the document or by the folding of the dog-ear back against the surface of the document if the tip of the dog-ear is initially at more than said predetermined distance from the plane of the document.

3. A document conveyor according to claim 1 comprising rotating means for rotating said breaking cylinder with a surface velocity equal to the velocity of said transportation of a document for the prevention of a folded document jamming thereagainst and for assisting in the urging of a document along said path.

4. A document conveyor according to claim 3, wherein the axis of said breaking cylinder lies in a direction having a component parallel to said path for the rotation of said cylinder to urge the edge of a document into said curved track.

5. A document conveyor according to claim 4, wherein said curved track comprises a slot in a base and wherein said curved boundary comprises only a single outside wall, extensive across the width of a document, forming the edge of said slot on the outside of said curved track.

6. A document conveyor according to claim 5 wherein said wall comprises an entrance lip, adjacent to said breaking cylinder, for forming a reducing path for a document between said lip and said breaking cylinder for the introduction of a document at the wide end of said reducing path and the movement of the document towards the narrow end of said reducing path whereby the distance between said breaking cylinder and said wall is gradually reducible as a document moves along said curved path for the gradual opening of the fold or folds in the document.

7. A document conveyor according to claim 2, comprising rotating means for rotating said breaking cylinder with a surface velocity equal to the velocity of said transportation of a document for the prevention of a folded document jamming thereagainst and for assisting in the urging of a document along said path.

8. A document conveyor according to claim 7, wherein the axis of said breaking cylinder lies in a direction having a component parallel to said path for the rotation of said cylinder to urge the edge of a document into said curved track.

9. A document conveyor according to claim 8, wherein said curved track comprises a slot in a base, and wherein said curved boundary comprises only a single outside wall, extensive across the width of a document, forming the edge of said slot on the outside of said curved track.

10. A document conveyor according to claim 9, wherein said wall comprises an entrance lip, adjacent to said breaking cylinder, for forming a reducing path for a document between said lip and said breaking cylinder for the introduction of a document at the wide end of said reducing path and the movement of the document towards the narrow end of said reducing path whereby the distance between said breaking cylinder and said wall is gradually reducible as a document moves along said curved path for the gradual opening of the fold or folds in the document.

11. A document conveyor according to claim 1, wherein said boundary comprises a plurality of guide cylinders disposed along said curved path, each of said guide cylinders extending to the full height of said document.

12. A document conveyor according to claim 11, wherein said plurality of guide cylinders comprises one or more idling cylinders, passively rotatable by the passage of a document thereagainst.

13. A document conveyor according to claim 11, wherein said plurality of guide cylinders comprises one or more driven cylinders,, rotatable to assist in the urging of a document along said curved path.

14. A document conveyor according to claim 13, wherein said driven cylinder or said driven cylinders is or are further operable to urge a document into said curved track.

15. A document conveyor according to claim 12, wherein said plurality of guide cylinders comprises one or more driven cylinders, rotatable to assist in the urging of a document along said curved path.

16. A document according to claim 15, wherein said driven cylinder or said driven cylinders is or are further operable to urge a document into said curved track.

17. A document conveyor according to claim 2, wherein said boundary comprises a plurality of guide cylinders disposed along said curved path, each of said guide cylinders extending to the full height of said document.

18. A document conveyor according to claim 17, wherein said plurality of guide cylinders comprises one or more idling cylinders, passively rotatable by the passage of a document thereagainst.

19. A document conveyor according to claim 17, wherein said plurality of guide cylinders comprises one or more driven cylinders, rotatable to assist in the urging of a document along said curved path.

20. A document conveyor according to claim 19, wherein said driven cylinder or said driven cylinders is or are further operable to urge a document into said curved track.

21. A document conveyor according to claim 18, wherein said plurality of guide cylinders comprises one or more driven cylinders, rotatable to assist in the urging of a document along said curved path.

22. A document conveyor according to claim 21, wherein said driven cylinder or said driven cylinders is or are further operable to urge a document into said curved track.

23. A document conveyor according to claim 3, wherein said boundary comprises a plurality of guide cylinders disposed along said curved path, each of said guide cylinders extending to the full height of said document.

24. A document conveyor according to claim 23, wherein said plurality of guide cylinders comprises one or more idling cylinders, passively rotatable by the passage of a document thereagainst.

25. A document conveyor according to claim 23, wherein said plurality of guide cylinders comprises one or more driven cylinders, rotatable to assist in the urging of a document along said curved path.

26. A document conveyor according to claim 25, wherein said driven cylinder or said driven cylinders is or are further operable to urge a document into said curved track.

27. A document conveyor according to claim 24, wherein said plurality of guide cylinders comprises one or more driven cylinders, rotatable to assist in the urging of a document along said curved path.

28. A document conveyor according to claim 27, wherein said driven cylinder or said driven cylinders is or are further operable to urge a document into said curved track.

29. A document conveyor according to claim 7, wherein said boundary comprises a plurality of guide cylinders disposed along said curved path, each of said guide cylinders extending to the full height of said document.

30. A document conveyor according to claim 29, wherein said plurality of guide cylinders comprises one or more idling cylinders, passively rotatable by the passage of a document thereagainst.

31. A document conveyor according to claim 29, wherein said plurality of guide cylinders comprises one or more driven cylinders, rotatable to assist in the urging of a document along said curved path.

32. A document conveyor according to claim 31, wherein said driven cylinder or said driven cylinders is or are further operable to urge a document into said curved track.

33. A document conveyor according to claim 30, wherein said plurality of guide cylinders comprises one or more driven cylinders, rotatable to assist in the urging of a document along said curved path.

34. A document conveyor according to claim 1, wherein said driver comprises a driven friction wheel in pressing engagement with an idler wheel at said entrance to said conveyor where a document is introducible into said conveyor by introduction therebetween.

35. A document conveyor according to claim 34, wherein said driven friction wheel is operable to impart a force to a document for urging the document into said curved track.

36. A document conveyor according to claim 3, wherein said driver comprises a driven friction wheel in pressing engagement with an idler wheel at said entrance to said conveyor where a document is introducible into said conveyor by introduction therebetween.

37. A document conveyor according to claim 36, wherein said driven friction wheel is operable to impart a force to a document for urging the document into said curved track.

38. A document conveyor according to claim 37, wherein said driven friction wheel is coupled to impart said rotation to said breaking cylinder.

39. A document conveyor according to claim 7, wherein said driver comprises a driven friction wheel in pressing engagement with an idler wheel at said entrance to said conveyor where a document is introducible into said conveyor by introduction therebetween.

40. A document conveyor according to claim 39, wherein said driven friction wheel is operable to impart a force to a document for urging the document into said curved track.

41. A document conveyor according to claim 40, wherein said driven friction wheel is coupled to impart said rotation to said breaking cylinder.

42. A document conveyor according to claim 38, wherein said breaking cylinder is coaxially and corotationally mounted upon said driven friction wheel.

43. A document conveyor according to claim 41, wherein said breaking cylinder is coaxially and corotationally mounted upon said driven friction wheel.

44. A document conveyor according to claim 1, wherein said breaking cylinder is a rotating cylinder, said rotating cylinder fixedly spaced from said boundary.

* * * * *